US010249416B2

(12) United States Patent
Huang et al.

(10) Patent No.: US 10,249,416 B2
(45) Date of Patent: Apr. 2, 2019

(54) SLIDE TYPE VARIABLE RESISTOR WITH RESISTANCE ADJUSTING MEMBER

(71) Applicant: TAIWAN ALPHA ELECTRONIC CO., LTD., Taoyuan (TW)

(72) Inventors: Tzu-Hsuan Huang, Taoyuan (TW); Wei-Liang Liu, Taoyuan (TW); Chien-Chih Ho, Taoyuan (TW)

(73) Assignee: TAIWAN ALPHA ELECTRONIC CO., LTD., Taoyuan (TW)

( * ) Notice: Subject to any disclaimer, the term of this patent is extended or adjusted under 35 U.S.C. 154(b) by 51 days.

(21) Appl. No.: 15/354,105

(22) Filed: Nov. 17, 2016

(65) Prior Publication Data

US 2017/0154712 A1 Jun. 1, 2017

(30) Foreign Application Priority Data

Dec. 1, 2015 (TW) ..... 104140121 A

(51) Int. Cl.

| | |
|---|---|
| ***H01C 10/38*** | (2006.01) |
| ***H01C 1/01*** | (2006.01) |
| ***H01C 10/00*** | (2006.01) |
| ***H01C 1/022*** | (2006.01) |

(52) U.S. Cl.

CPC ..... *H01C 10/38* (2013.01); *H01C 1/01* (2013.01); *H01C 1/022* (2013.01); *H01C 10/005* (2013.01)

(58) Field of Classification Search

CPC ..... H01C 10/38; H01C 1/01; H01C 1/022
USPC ..... 338/118, 176
See application file for complete search history.

(56) References Cited

U.S. PATENT DOCUMENTS 3,550,059 A * 12/1970 Van Benthuysen .... H01C 10/38 338/176
4,047,146 A * 9/1977 Takeyama ..... H01C 10/38 200/304
5,825,279 A * 10/1998 Yagi ..... H01C 10/44 338/118

* cited by examiner

*Primary Examiner* — Kyung S Lee
*Assistant Examiner* — Iman Malakooti
(74) *Attorney, Agent, or Firm* — Muncy, Geissler, Olds & Lowe, P.C.

(57) ABSTRACT

A slide type variable resistor with a resistance adjusting member, comprising a housing, two side rails, a circuit module, a control member and a base. The housing includes a housing limiting hole and a space. The two side rails are disposed in the space. The circuit module is disposed in the space and has a resistive circuit. The control member is disposed in the space. The control member includes an object, at least one metal brush, a handle and an elastic member. The object having a bump, and the elastic member is sleeved at the bump.

7 Claims, 5 Drawing Sheets

SLIDE TYPE VARIABLE RESISTOR WITH RESISTANCE ADJUSTING MEMBER

This application claims the benefit of Taiwan Patent Application Serial No. 104140121, filed Dec. 1, 2015, the subject matter of which is incorporated herein by reference.

BACKGROUND OF INVENTION

1. Field of the Invention

The present invention is related to a slide type variable resistor, and more particularly is related to a slide type variable resistor with resistance adjusting member.

2. Description of the Prior Art

It is common in our daily life to adjust the value of an output voltage signals by using a manipulating device, such as the variable resistor. Based on the type of operation, the variable resistors can be sorted as rotating-type variable resistors and slide-type variable resistors.

FIG. 1 is an explosive view of a conventional slide type variable resistor. As shown, the variable resistor PA100 includes a circuit base PA1, a manipulating module PA2, and a housing PA3. The circuit base PA1 includes a circuit board PA11 and a plurality of pins PA12. The manipulating module PA2 includes a slidable unit PA21, two metal brushes PA22, a handle PA23, an elastic plate PA24, and a washer PA25. The slidable unit PA21 is moveably assembled on the circuit board PAll along the manipulating direction L. The two metal brushes PA22 are assembled on a back surface of the slidable unit PA21 for pressing against the resistor circuit on the circuit board PAll. The handle PA23 is assembled on a front surface of the slidable unit PA21, and penetrates the elastic plate PA24 and the washer PA25 located thereon in sequence. The housing PA3 is fixed on the circuit base PA1, and has a position limiting hole PA31 and a plurality of fixing parts PA32. The handle PA23 extends outward from the position limiting hole PA31, and the fixing parts PA32 are utilized for fixing the housing PA3 on the circuit base PA1.

As mentioned, as for the conventional technology, the slidable unit PA21 is arranged to contact the circuit board PA11 directly. In order to have the manipulating module PA2 moving along the manipulating direction L back and forth smoothly, the friction between the slidable unit PA21 and the circuit board PA11 is designed to be small. However, as the variable resistor PA100 is set on an inclined platform, a movable platform, or the wall, the slidable unit PA21 may slide down automatically due to the influence of gravity such that the resistor value of the variable resistor PA100 would be changed. In addition, because of the small friction between the slidable unit PA21 and circuit board PA11 of the conventional variable resistor PA100, a minor touch by the user during the operation may cause a great influence to the resistor value. For the electric apparatuses sensitive to the resistor value, a minor touch by the user may cause a huge reaction.

SUMMARY OF THE INVENTION

In view of the variable resistor of the conventional art, which has the slidable unit located on the circuit board directly, because of a small friction between the slidable unit and the circuit board, the user can push the handle easily. However, as the variable resistor is set on an inclined or vertical plane, the slidable unit would be sensitive to gravity and may slide down due to the small friction between the slidable unit and the circuit board, such that the position of the handle cannot be maintained and the output signal would be changed. Accordingly, it is a main object of the present invention to provide a slide type variable resistor, which features the resistance adjusting member to adjust or change the friction on the manipulating device.

In order to resolve the above mentioned problem, a slide type variable resistor with a resistance adjusting member is provided in accordance with an embodiment of the present invention. The slide type variable resistor with resistance adjusting member comprises a housing, two side rails, a circuit module, a manipulating device and a base.

The housing has a housing position limiting hole extending along a manipulating direction, and an accommodation space spatially communicated to the housing position limiting hole is formed. The two side rails extend along the manipulating direction and are symmetrically located in the allocation space. The circuit module is located in the accommodation space and has a resistor circuit.

The manipulating device is located in the allocation space, and comprises a slidable unit, at least one metal brush, a handle, and an elastic member. The slidable unit is slidably located between the two side rails along the manipulating direction and has a bump. The metal brush is fixed on the slidable unit and with elastic force to press against the resistor circuit. The handle is connected to the slidable unit and extends outward through the housing position limiting hole. The elastic member is sleeved on the bump.

The base is fixed to the housing and is utilized for enclosing the accommodation space to constrain the two side rails, the circuit module and the manipulating device in the allocation space, and the base also presses against the elastic member.

In accordance with an embodiment of the present invention, the circuit module comprises a circuit board and a plurality of pins. The circuit board is fixed between the two side rails and has a circuit board position limiting hole extending along the manipulating direction, and the resistor circuit is located on a back surface of the circuit board. The pins are located on the circuit board and penetrate through the base respectively. As a preferred embodiment, the slidable unit has a front surface and a back surface, the front surface of the slidable unit faces the back surface of the circuit board, the handle is inserted to the front surface of the slidable unit, the metal brush is located on the front surface of the slidable unit, the back surface of the slidable unit faces the base, and the bump is located on the back surface of the slidable unit. In addition, the base further comprises a plurality of through holes corresponding to the pins, and the pins penetrate the through holes respectively.

In accordance with an embodiment of the present invention, the base comprises a base body and two end locking parts. The two end locking parts are symmetrically located on two ends of the base body and press against the two side rails respectively to fix the two side rails in the allocation space.

In accordance with an embodiment of the present invention, each of the side rails includes a circuit board fixing groove. The two sides of the circuit board are fixed in the circuit board fixing grooves of the two side rails respectively so as to have the circuit board fixed in the allocation space.

In accordance with an embodiment of the present invention, each of the side rails includes a slidable unit guiding trench. The two sides of the slidable unit are moveably located in the slidable unit guiding trenches of the two side rails along the manipulating direction respectively so as to have the circuit board fixed in the allocation space.

As mentioned, in compared with the conventional variable resistor, the slide type variable resistor with resistance adjusting member provided in the present invention features an elastic member located on the bottom of the slidable unit for pressing against the base to generate friction such that when operating the manipulating device, a certain resistance must be overcome so as to give the user a better feeling and enhance operational stability.

DESCRIPTION OF THE PREFERRED EMBODIMENT

Figure 1:
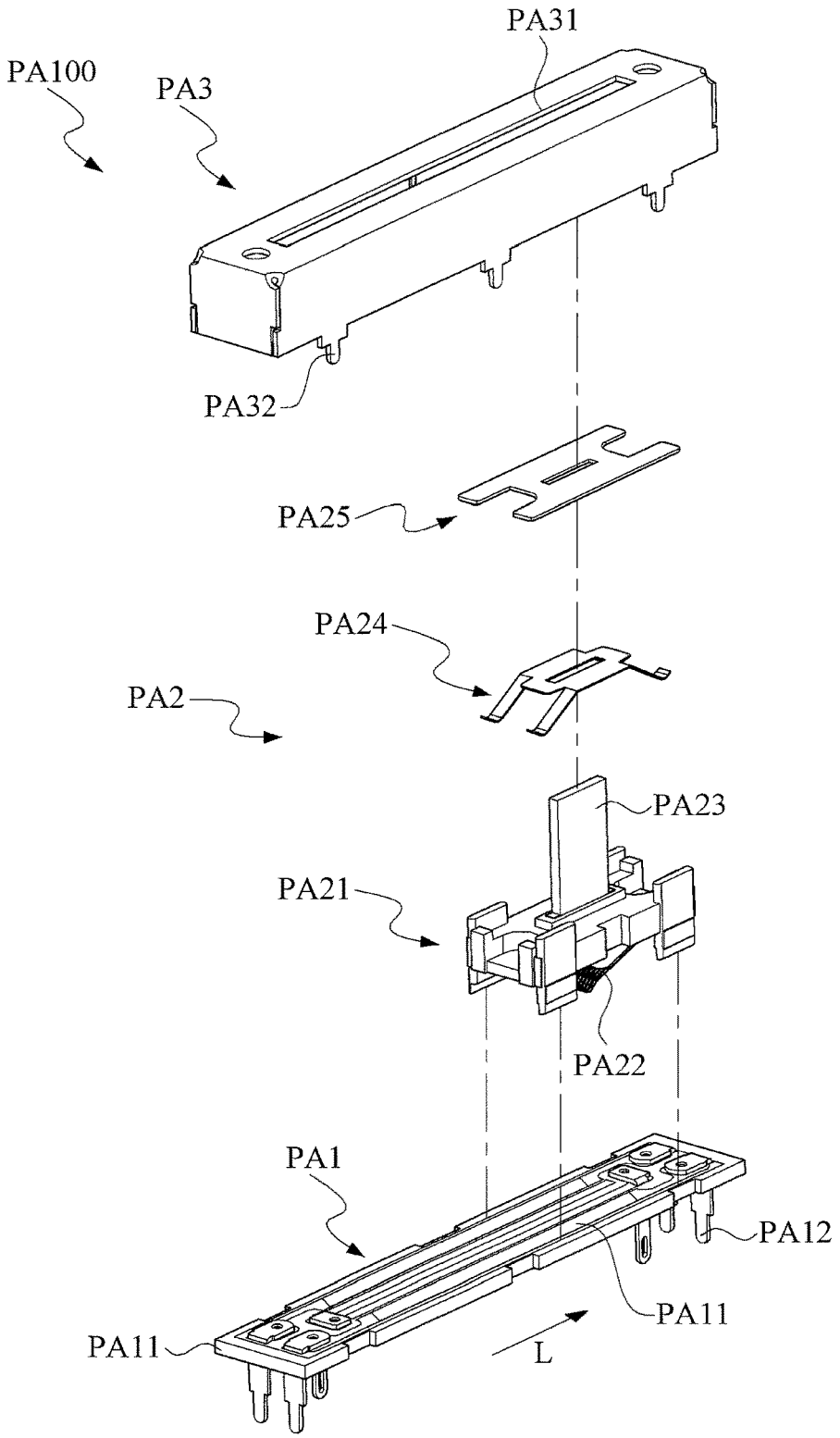
FIG.1(Prior Art)
FIG. 1 is a 3D explosive view of a conventional variable resistor.
Figure 2:
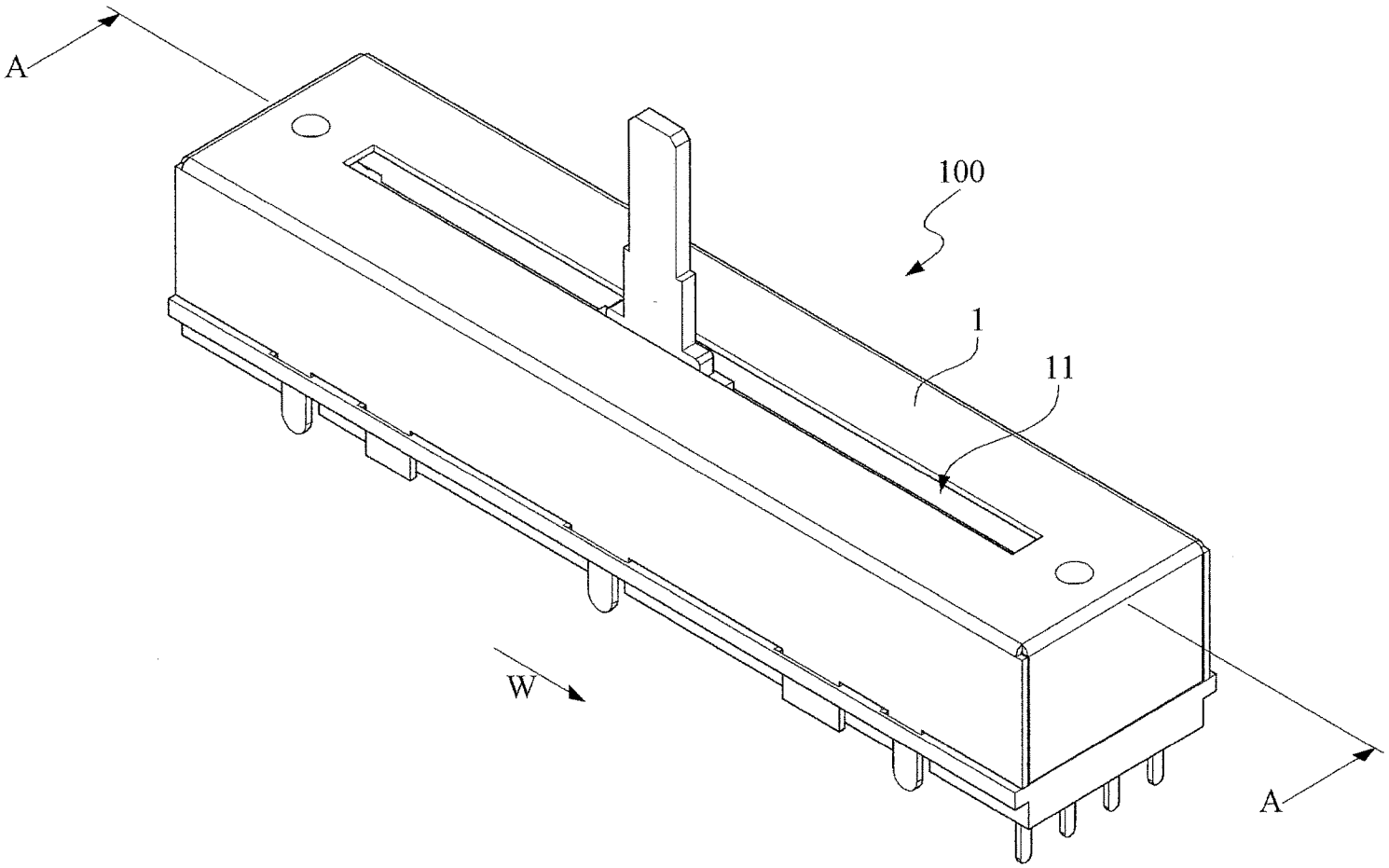
FIG. 2 is a 3D schematic view of a slide type variable resistor with resistance adjusting member provided in accordance with a preferred embodiment of the present invention.
Figure 3:
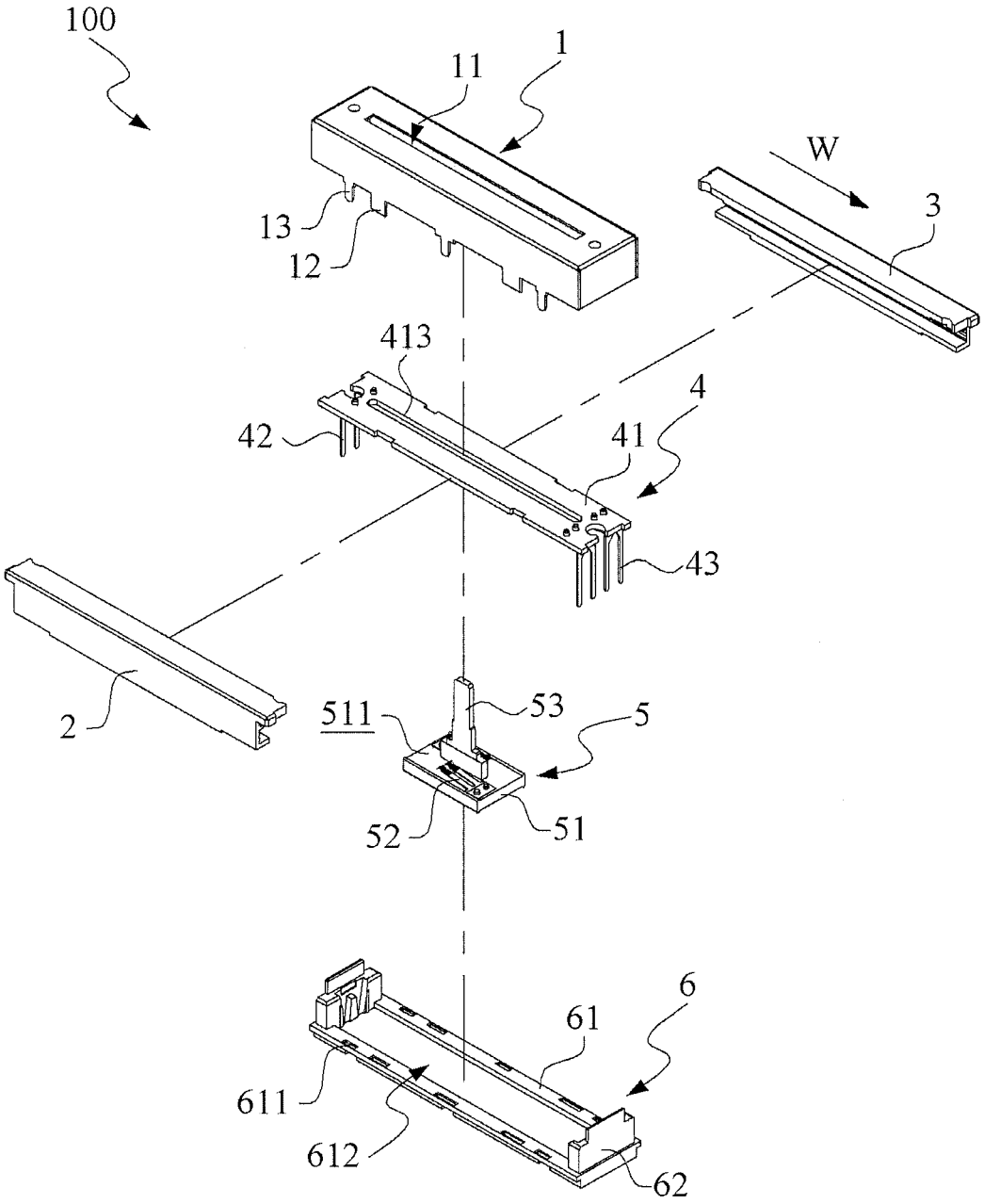
FIG. 3 is a 3D explosive view of the slide type variable resistor with resistance adjusting member provided in accordance with a preferred embodiment of the present invention.
Figure 4:
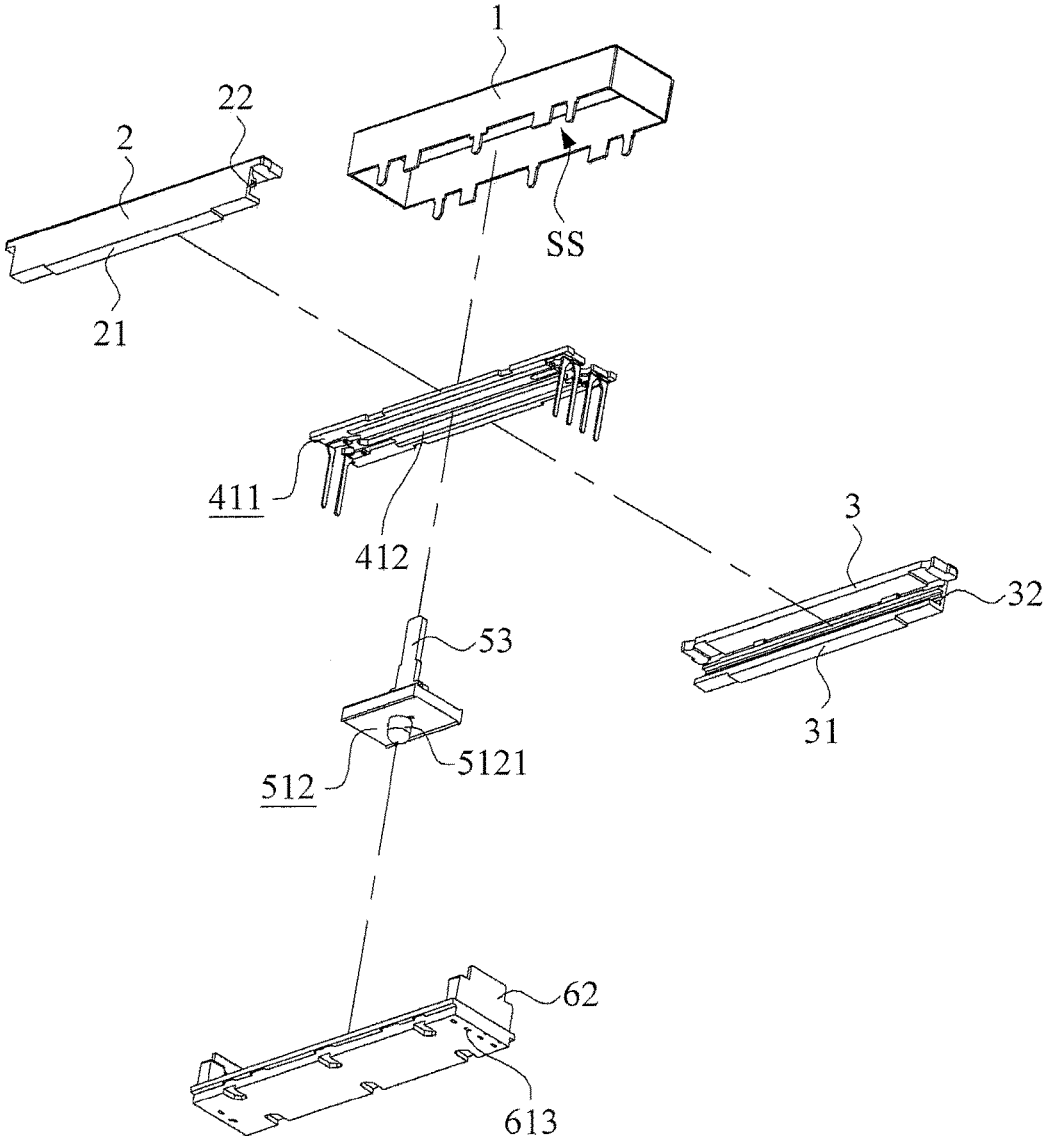
FIG. 4 is a 3D explosive view of the slide type variable resistor with resistance adjusting member provided in accordance with a preferred embodiment of the present invention from another viewing angle.

Please refer to FIG. 2 to FIG. 4, wherein FIG. 2 is a 3D schematic view of a slide type variable resistor with resistance adjusting member provided in accordance with a preferred embodiment of the present invention; FIG. 3 is a 3D explosive view of the slide type variable resistor with resistance adjusting member provided in accordance with a preferred embodiment of the present invention; and FIG. 4 is a 3D explosive view of the slide type variable resistor with resistance adjusting member provided in accordance with a preferred embodiment of the present invention from another viewing angle. As shown, the slide type variable resistor 100 includes a housing 1, two side rails 2 and 3, a circuit module 4, a manipulating device 5 and a base 6.

The housing 1 has a housing position limiting hole 11 extending along a manipulating direction W, and an accommodation space SS spatially communicated to the housing position limiting hole 11 is formed therein. Wherein, the housing 1 further includes four positioning parts 12 (only one of them is labelled in the figure) and six fixing parts 13 (only one of them is labelled in the figure).

The two side rails 2 and 3 are extending along the manipulating direction W and symmetrically located in the accommodation space SS. The side rail 2 has a supporting part 21 and a slidable unit guiding trench 22, and the side rail 3 also has a supporting part 31 and a slidable unit guiding trench 32, wherein the slidable unit guiding trench 22 and the slidable unit guiding trench 32 are symmetrically arranged.

The circuit module 4 is located in the accommodation space SS and includes a circuit board 41, two first pins 42 (only one of them is labelled in the figure) and four second pins 43 (only one of them is labelled in the figure).

The circuit board 41 is fixed between the side rails 2 and 3, and has a back surface 411 thereof. The back surface 411 of the circuit board is opposite to the housing position limiting hole 11. Two resistor circuits 412 (only one of them is labelled) are located on the back surface 411 of the circuit board, and the circuit board 41 also has a circuit board position limiting hole 413 extending along the manipulating direction W. The two sides of the circuit board 41 are fixed in the circuit board fixing grooves (not labelled) of the two side rails 2 and 3 respectively, and the circuit board fixing grooves are located on the slidable unit guiding trenches 32 to have the circuit board 41 fixed in the accommodation space SS.

The first pins 42 and the second pins 43 are located on the two ends of the circuit board 41 for electrically connected to the corresponding circuit board resistor circuits 412 respectively.

The manipulating device 5 includes a slidable unit 51, two metal brushes 52 (only one of them is labelled), a handle 53, and an elastic member 54. The slidable unit 51 is guided by the slidable unit guiding trench 22 and slidable unit guiding trench 32 so as to be slidably located between the two side rails 2 and 3 along the manipulating direction W. The slidable unit 51 has a front surface 511 and a back surface 512, the front surface 511 of the slidable unit faces the back surface 411 of the circuit board, and a bump 5121 is located on the back surface 512 of the slidable unit.

The metal brushes 52 are fixed on the front surface 511 of the slidable unit and with elastic force to press against the resistor circuits 412. The handle 53 is connected to the front surface 511 of the slidable unit and extends outward through the housing position limiting hole 11. The elastic member 54 is firmly sleeved on the bump 5121.

The base 6 is fixed to the housing 1 and is utilized for enclosing the accommodation space SS to constrain the two side rails 2 and 3, the circuit module 4 and the manipulating device 5 in the accommodation space SS.

The base 6 includes a base body 61 and two end locking parts 62 (only one of them is labelled). The base body 61 has ten side holes 611 (only one of them is labelled) and a trench 612 on two sides thereof. These side holes 611 are utilized for locating the aforementioned four positioning parts 12 and six fixing parts 13, wherein the positioning parts 12 are utilized for penetrating the corresponding side holes 611 to position the housing 1, and the fixing parts 13 would be further bended against the base 6 after penetrating the corresponding side holes 611 to have the housing 1 fixed to the base 6. The trench 612 is utilized for pressing against the elastic member 54 to have the elastic member 54 moving in the trench 612. The supporting part 21 of the side rail 2 and the supporting part 31 of the side rail 3 are pressing against the two sides of the base body 61 between the side holes 611 and the trench 612.

The two end locking parts 62 (only one of them is labelled) are symmetrically located on two ends of the base body 61 and press against the two side rails 2 and 3 respectively to fix the two side rails 2 and 3 in the accommodation space.

Figure 5:
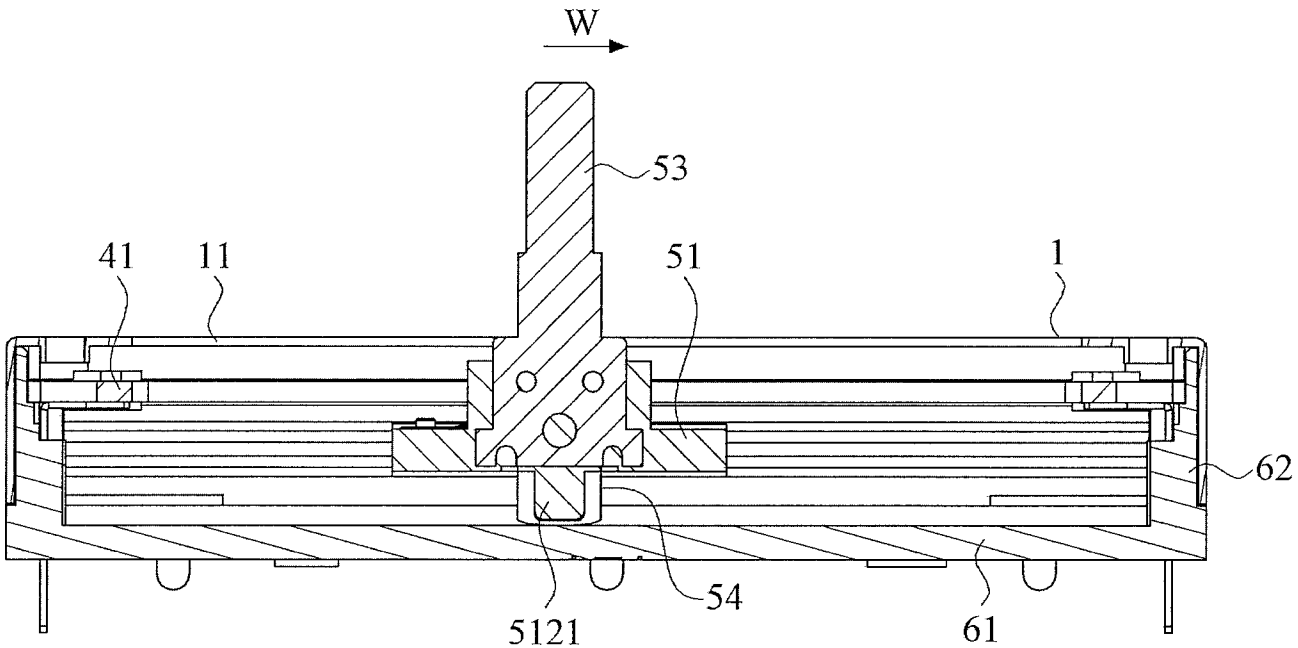
FIG. 5 is a cross-section view along A-A cross section in FIG. 2.

Please also refer to FIG. 5, which is a cross-section view along A-A cross section in FIG. 2. A shown, as the slidable unit 51 is positioned by the two side rails 2 and 3 and the base 6 is fixed to the housing 1, the elastic member 54 pressing against the base 6 would be interfered with the base 6 to cause elastic deformation such that a static friction would be generated between the elastic member 54 and the manipulating device 5 as the manipulating device 5 is stationary and a certain resistance would be generated as the manipulating device 5 is moving along the extending direction W.

To sum up, the slide type variable resistor with resistance adjusting member provided in the present invention features the elastic member located on the bottom of the slidable unit which presses against the base to cause interference, such that as the user moves the handle along the extending direction L, the elastic member driven by the slidable unit would be elastically deformed to cause the resistance against the movement of the manipulating device such that the user needs to apply a certain force in order to move the handle. In addition, because of the contact between the elastic member and the base, a static friction would be also generated to prevent the unwanted movement of the manipulating device due to a slight shaking or a minor touch by the user so as to enhance operational stability effectively.

The detail description of the aforementioned preferred embodiments is for clarifying the feature and the spirit of the present invention. The present invention should not be limited by any of the exemplary embodiments described herein, but should be defined only in accordance with the following claims and their equivalents. Specifically, those skilled in the art should appreciate that they can readily use the disclosed conception and specific embodiments as a basis for designing or modifying other structures for carrying out the same purposes of the present invention without departing from the scope of the invention as defined by the appended claims.

What is claimed is:

1. A slide type variable resistor with a resistance adjusting member, comprising:

a housing, having a housing position limiting hole extending along a manipulating direction, and forming an accommodation space spatially communicated to the housing position limiting hole;

two side rails, extending along the manipulating direction and symmetrically located in the accommodation space;

a circuit module, located in the accommodation space and having a resistor circuit;

a manipulating device, located in the accommodation space, and comprising:

a slidable unit, slidably located between the two side rails along the manipulating direction, and having a bump;

at least one metal brush, fixed on the slidable unit and with elastic force to press against the resistor circuit;

a handle, connected to the slidable unit and extending outward through the housing position limiting hole; and an elastic member, sleeved on the bump; and a base, fixed to the housing and utilized for enclosing the accommodation space to constrain the two side rails, the circuit module and the manipulating device in the accommodation space, and further having a trench for pressing against the elastic member to have the elastic member moving therein.

2. The slide type variable resistor with a resistance adjusting member of claim 1, wherein the circuit module comprises:

a circuit board, fixed between the two side rails, and having a circuit board position limiting hole extending along the manipulating direction, and the resistor circuit being located on a back surface of the circuit board; and a plurality of pins, located on the circuit board and penetrating through the base respectively.

3. The slide type variable resistor with resistance adjusting member of claim 2, wherein the slidable unit has a front surface and a back surface, the front surface of the slidable unit faces the back surface of the circuit board, the handle is inserted to the front surface of the slidable unit, the metal brush is located on the front surface of the slidable unit, the back surface of the slidable unit faces the base, and the bump is located on the back surface of the slidable unit.

4. The slide type variable resistor with resistance adjusting member of claim 2, wherein the base further comprises a plurality of through holes corresponding to the pins, and the pins penetrate the through holes respectively.

5. The slide type variable resistor with resistance adjusting member of claim 1, wherein the base comprises:

a base body; and two end locking parts, symmetrically located on two ends of the base body and pressing against the two side rails respectively to fix the two side rails in the accommodation space.

6. The slide type variable resistor with resistance adjusting member of claim 1, wherein each of the side rails includes a circuit board fixing groove, two sides of the circuit board are fixed in the circuit board fixing grooves of the two side rails respectively so as to have the circuit board fixed in the accommodation space.

7. The slide type variable resistor with resistance adjusting member of claim 1, wherein each of the side rails includes a slidable unit guiding trench, two sides of the slidable unit are moveably located in the slidable unit guiding trenches of the two side rails along the manipulating direction respectively so as to have the circuit board fixed in the allocation space.

* * * * *